US007252645B2

(12) United States Patent
Polins

(10) Patent No.: US 7,252,645 B2
(45) Date of Patent: Aug. 7, 2007

(54) MASSAGE THUMB TOOL

(76) Inventor: Greg Polins, 2422 Teal Ave., Sarasota, FL (US) 34232

( * ) Notice: Subject to any disclaimer, the term of this patent is extended or adjusted under 35 U.S.C. 154(b) by 528 days.

(21) Appl. No.: 10/867,917

(22) Filed: Jun. 15, 2004

(65) Prior Publication Data

US 2005/0277857 A1 Dec. 15, 2005

(51) Int. Cl.
*A61H 7/00* (2006.01)

(52) U.S. Cl. ..... 601/135; 601/137; 601/15; 607/111

(58) Field of Classification Search ..... 401/7; 2/21
See application file for complete search history.

(56) References Cited

U.S. PATENT DOCUMENTS 994,856 A * 6/1911 Mariner ..... 2/21
1,315,035 A 9/1919 Post
1,795,500 A * 3/1931 Omundson ..... 132/149
1,885,572 A * 11/1932 Wood ..... 601/137
1,980,635 A * 11/1934 Rasmussen et al. ..... 2/21
2,523,606 A 9/1950 Young
3,043,295 A * 7/1962 Ward ..... 601/139
3,745,590 A 7/1973 Stubstad
4,308,860 A * 1/1982 Sanders et al. ..... 601/137
4,653,490 A 3/1987 Eisenberg
4,953,568 A 9/1990 Theisler
5,063,613 A 11/1991 Brown
5,346,462 A 9/1994 Barber
5,474,093 A 12/1995 Pettiet
5,787,896 A 8/1998 Sackett
5,899,870 A 5/1999 Deirmendjian et al.
5,954,245 A 9/1999 Kluesner
6,325,772 B1 12/2001 Scheuermann et al.
6,520,925 B1 2/2003 Thibodo, Jr.
6,532,963 B2 3/2003 Swanbeck
6,918,137 B2 * 7/2005 Fowler ..... 2/16

* cited by examiner

*Primary Examiner*—Danton DeMille
(74) *Attorney, Agent, or Firm*—Charles J. Prescott

(57) ABSTRACT

A thumb tool for use by a massage therapist includes a tubular sleeve having at least a portion of which is a rigid plastic tubular sleeve that slides over the thumb. A portion of the tool may include a flexible PVC thermo plastic membrane. The tool may be a one-piece construction or may include multiple layers or removable inserts. The tool and/or an insert may comprise a gel-like substance acting as thermal medium that may be heated or cooled for individualized thermal therapy.

14 Claims, 7 Drawing Sheets

MASSAGE THUMB TOOL

There are no related patent applications.

The application did not receive federal research and development funding.

BACKGROUND OF THE INVENTION

The present invention generally relates to a supportive device for use by one who performs massage therapy. More particularly, the device relates to a massage thumb tool comprising a semi-pliable, plastic, tubular sleeve comprising an interior and an exterior shape reflecting the shape of a human thumb. The device allows a massage therapist to feel and detect problem areas in tissue that is being massaged while having a real-like touch to the recipient of the massage therapy.

The interior of the device may comprise an adsorptive or absorptive material for collecting moisture generated or expelled from the skin of the thumb of the wearer. This material wicks moisture away from the skin of the wearer. The design of the device ensures a comfortable fit by the user while providing an undetectable touch from the device that is indistinguishable between an actual touch of a massage therapist and a touch from the massage therapist wearing the device. The device also acts as an exoskeleton that supports an exterior of a thumb and comprises a substantially incompressible material while being pliable such that the use of the device is undetectable by whom the device is used upon while allowing the user to detect problem areas in the muscle tissue.

In one embodiment, the device includes an interior comprising an adhesive that binds an interior coating material contacting a skin of a wearer to the exterior shell. The device may be slipped over a thumb of a massage therapist, physical therapist, chiropractor or other such individual requiring a sensitive touch to detect problem areas such as tight muscles, muscle dysfunction, muscle aggravation or the presence of soft tissue adhesions, while providing an indistinguishable or undetectable touch to the person who is receiving the massage therapy.

The device may comprise a light-weight plastic material providing compressive relief exerted onto an end of the thumb and includes a front side including at least a portion of which is pliable to be used on one receiving massage therapy. The device also includes at least a portion that is rigid. In one embodiment, the back side and tip of the device are rigid. Thus, the device protects the thumb from being over extended towards the wrist while providing a freedom of movement such that the wearer may flex the thumb towards the palm of the hand. The device also provides compressive relief on the joints of the thumb and their surrounding tissue. Thus, the device acts as an exoskeleton for providing compression relief to prevent thumb joints and surrounding tissue from becoming aggravated, re-aggravated or injured by repetitive motions performed during deep tissue or neuromuscular massages.

A massage therapist performs many tasks requiring the use of the thumb during a massage session. Some such tasks include performing deep tissue or neuromuscular massage of soft tissue adhesions throughout the human body. During these procedures, the massage therapist must apply a compressive force to a distal end of their thumb. Certain repetitious motions involving bending the tip of the thumb towards the wrist are commonly experienced during a normal massage session.

Repeated use of a thumb to perform these tasks may lead to painful medical conditions. Some of the common problems that may be associated with repeated use of a thumb to perform massage tasks may include: carpal tunnel syndrome, bursitis, tendinopathy, De Quervain's tenosynovitis and Repetitive Motion Syndrome.

Carpal tunnel syndrome is caused by pressure on a nerve in the wrist. Typically, this syndrome is caused by prolonged or repeated use of certain tasks involving the hands or wrist which puts pressure on the median nerve to cause swelling or thickening of tissues close to or within the carpal tunnel. Symptoms include tingling, numbness, weakness or pain in the fingers or thumb and hand and are common in many massage therapists.

Bursitis is an inflammation of a bursa which is a small sac of fluid that cushions and lubricates the area between one bone and another bone. Bursitis may be caused by prolonged or repeated pressure on a bursa such as when a compressive force is repeatedly applied to an end of a thumb or by activities that require repeated twisting of a joint such as when a massage therapist performs deep tissue massage therapy.

Tendons are rope like fibers that connect muscles to bones. Tendinopathy includes inflammation and can be caused by long-term overuse of a thumb. It is typically caused by repeated twisting or rapid joint movements such as those performed by massage therapists on a daily basis.

De Quervains's tenosynovitis is a condition that causes swelling and inflammation of the tendons and tendon sheath on the thumb side of the wrist. Symptoms include pain, tenderness and swelling along the thumb side of the wrist that spreads down the thumb and forearm. Other symptoms may include a feeling of weakness or a grating feeling at the wrist when moving the thumb or wrist. It is believed that activities that require repeated wrist and thumb movements such as those performed by a massage therapist during deep tissue massage therapy may contribute to or cause this condition.

Repetitive Motion Syndrome describes symptoms such as pain, swelling or tenderness which occur from repeating the same motion over and over. This syndrome can cause tissues to swell and become fatigued, thereby putting pressure on the nerves and causing symptoms listed above. Many massage therapists suffer from this syndrome.

Several known devices are for use with a thumb. However, it is believed that none of these devices act as an exoskeleton and a compressive force shock absorber while allowing a user to maintain a feeling in the thumb for administering a massage as in the present invention.

U.S. Pat. No. 1,315,035 to Post discloses a foot treating appliance for use in treatment of a foot with a view to replacing misplaced bones and correcting broken arches. A disk-like contact piece such as rubber, cork, felt or other such material is carried at the forward end of a thumb stall. The thumb stall is of such length that the operator's thumb merely touches the forward end of the stall. The forward end of the stall is preferably closed by a wall 3 that is adapted to isolate the thumb from the contact piece. The contact piece is used for contacting a dislocated bone and forcing it back into place. Thus, the thumb stall must be rigid in nature and may be made of light sheet metal or other appropriate material. Since the thumb stall is made from rigid material, the foot treating appliance prevents the user from feeling anything through the thumb stall.

U.S. Pat. No. 6,532,963 to Swanbeck discloses a thumb protector including a base sleeve coupled with a connector to a tip sleeve to be fitted over a thumb to protect the thumb from trauma that may occur when struck by a hammer. The thumb protector includes a base sleeve having an open front portion and an open rear portion. The base sleeve is adapted to be fitted over a proximal segment of a thumb. The thumb protector also includes a tip sleeve having an open front portion and open rear portion. The tip sleeve fits over the distal end of the thumb and is sufficiently sturdy so as to prevent the distal end from being injured when the tip sleeve is struck by a blow from a hammer. Thus, the device provides support in the direction normal to the thumb not in a direction parallel to the thumb.

SUMMARY OF THE INVENTION

The present invention is a thumb tool for use by a massage therapist. The tool comprises a tubular sleeve having at least a portion of which is a rigid plastic tubular sleeve that slides over the thumb. A portion of the tool may comprise a flexible poly-vinyl chloride, (PVC) thermo plastic membrane. The tool may be a one-piece construction or may include multiple layers or removable inserts. The tool or an insert may comprise a gel-like substance acting as thermal medium that may be heated or cooled for individualized thermal therapy. For example, a cold substance such as ice may be applied to an injured area of the body to reduce swelling by constricting capillaries to slow down the flow of blood and other fluids to the injured area. It is also known that cold therapy helps reduce the sensation of pain and provides a soothing, refreshing, and relaxing feeling to the injured area. While heat therapy is beneficial in reducing bruising by helping break down pockets of fluids such as blood which contribute to swollen and bruised areas. Heat therapy also increases comfort and relaxation for injured or sore muscles.

The tool covers the thumb from tip to trapezium and is designed for ambidextrous use by anyone. It may be used as a thumb tool by a massage therapist, physical therapist or chiropractor while performing deep tissue or neuromuscular massage of soft tissue adhesions throughout the human body. It provides compression relief to aggravated thumb joints and surrounding muscle tissue. The thumb massage tool provides support to the thumb joints of the massage therapist while he is performing direct pressure, cross fiber friction or deep stripping of the aggravated muscle tissue wherever there is muscular dysfunction, aggravation or the presence of soft tissue adhesions. For use, the therapist merely slides his thumb into the sleeve which comprises a thin plastic material. The therapist does not lose his sense of touch while using the tool. The tool is shaped substantially similar to the human thumb and includes a smooth exterior texture that has a life-like feel such that the patient is unaware of the presence or use of the tool. Fastening devices are unnecessary for retaining tool on the thumb of the user. Thus, the tool may be easily removed and placed on the therapist's other thumb without hesitation. The inner diameter of the tool is such that the interior of the tool exerts enough pressure against the skin of the thumb to create a coefficient of friction that retains the tool on the thumb of the therapist.

It is an object of the invention to provide a tool for use in massage therapy that supports the thumb joints and which may act as an exoskeleton for supporting the thumb and resisting compressive forces exerted between the tip of the thumb and at least one of the thumb joints.

It is another object of the invention to provide a tool for use in providing a massage therapy to a muscular area of a human or animal. The tool may act as a shock absorber by cushioning a compressive or a force exerted on the end of the thumb.

It is a further object of the invention to provide a tool that allows a massage therapist to detect problem areas such as soft tissue adhesions or swollen areas in the muscles while providing a compressive relief to the thumb and thumb joints to prevent the injuries and diseases previously discussed.

It is another object of the invention to provide a tool that having an exterior shape of a thumb. An exterior of the tool is smooth such that a massage therapist may use the device upon a patient without the patient's knowledge of such use. The tool may also include a window of pliable material that may cover a portion or all of the entire thumb from tip to trapezium and comprised of a thin plastic material. The device has a frictional force for holding it on the thumb and includes a dynamic spring force that resists compressive forces in relation to amount of force exerted on end of the thumb while allowing real feel to both the patient and the therapist. That is, the device comprises a material that resists compressive forces according the magnitude of the forces.

It is a further object of the invention to provide a device that is also impervious to infectious diseases which may transmitted through bodily fluids from the patient to the therapist and vise versa.

It is another object of the invention to provide a tool having a lip that transfers compressive forces from the thumb into the tissue of the hand at the base of the thumb between the thumb and index finger. The tool thereby prevents the aforementioned injuries and alleviates stress on the joints in the thumb by transferring compressive forces from the tip of the thumb to the wrist and muscle material between the thumb and forefinger.

It is another object of the invention to provide a device that includes a back side that prevents the thumb from being hyper-extended in a direction such that the tip of the thumb is resisted from moving towards the wrist while providing a degree of freedom of movement and preventing the metacarpalphalangeal thumb joint from being over rotated. The device resists a degree of rotative forces about the base thumb joint or metacarpalphalangeal joint while allowing a limited degree of freedom of movement. Thus, the thumb may be folded into the palm of the hand. This may be achieved by providing a device comprising a sleeve that is shorter on a front side than a back side.

It is a further object of the invention to provide a tool that includes an insert or sleeve of similar shape that includes a gel similar to that used in heat or ice pack. The tool may comprise white crylon gel, such as is sold by PainReliever-.com of Wichita, Kans., that may be heated and cooled. Thus, the device may be heated or cooled to provide thermal therapy simultaneous with the massage therapy.

These and other objects of the invention will become apparent to those skilled in the art upon review of the following drawings and appended claims.

DETAILED DESCRIPTION OF THE INVENTION

The following is the preferred embodiment or best mode for carrying out the invention. It should be noted that this invention is not limited by the discussion of the preferred embodiment.

Figure 1:
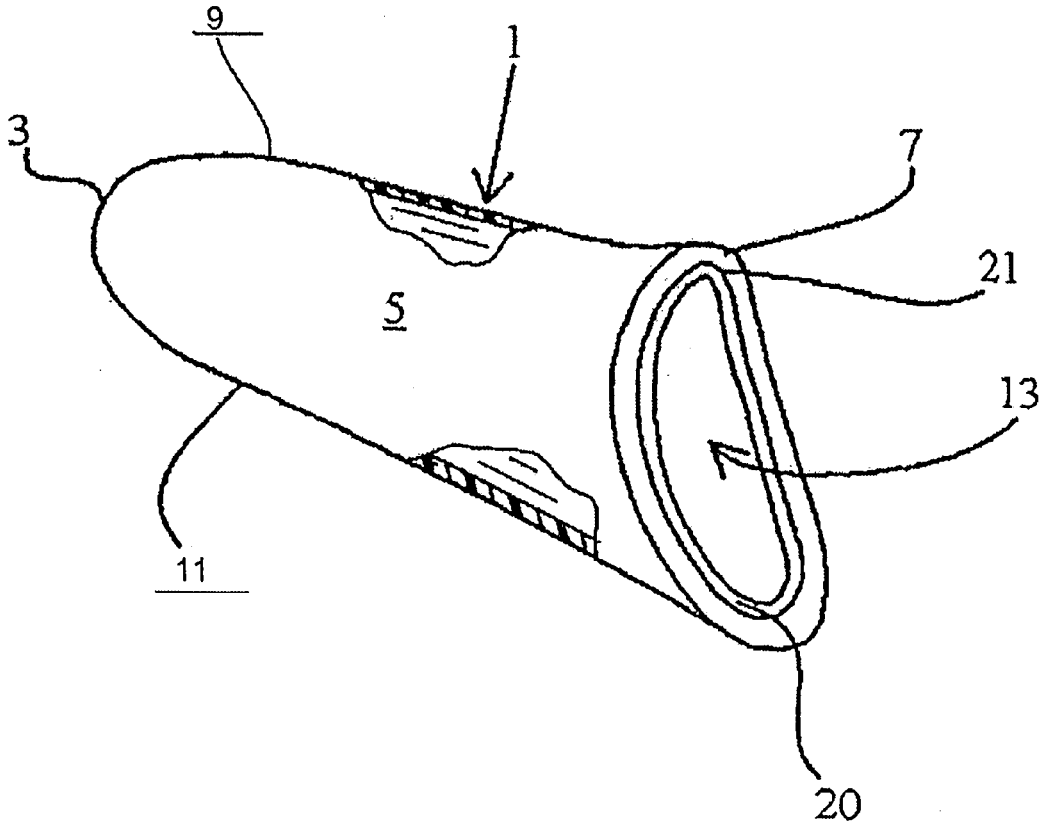
FIG. 1 is a perspective view of a first embodiment of the present invention.
Figure 4:
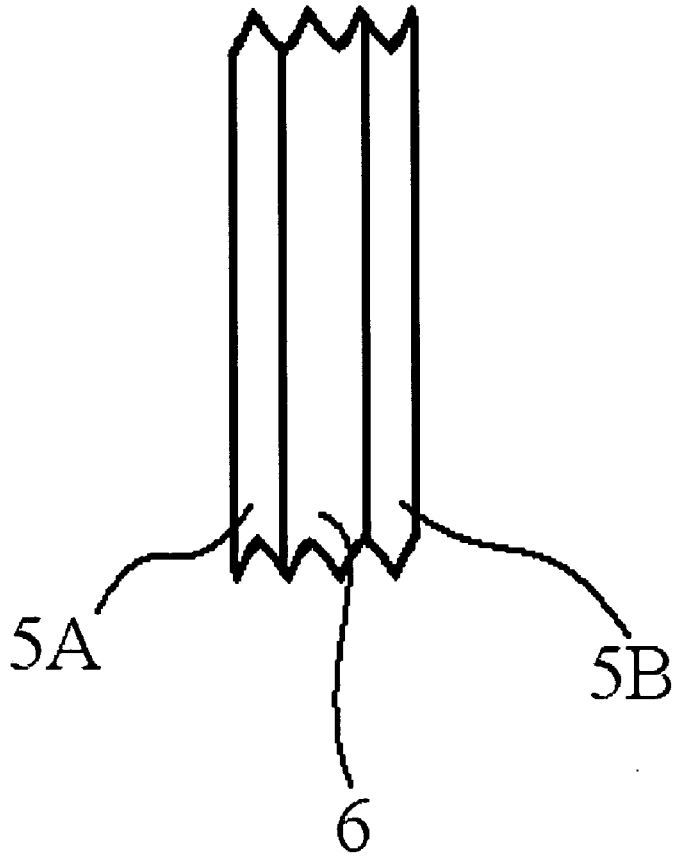
FIG. 4 is a partial cross sectional view showing the sidewall comprising a gel for use in a thermal treatment.

FIG. 1 is a perspective of the tool 1 and showing the various parts. In a first embodiment, the tool 1 comprises a one-piece flexible PVC thermo plastic membrane that includes a sidewall 5 and an opening 13 into which the thumb 100 of a user is inserted. The sidewall 5 includes a front sidewall 9 and a back sidewall 11. The back sidewall 11 is longer in length from the tip 3 to base 7 as shown to resist overextension of the tip of the thumb towards the wrist. Back sidewall 11 may extend from the tip 3 to the trapezium 107, shown in FIG. 6, and may comprise a more rigid material than front sidewall 9. This may be achieved by thickening the back sidewall 11 such that the cross section is thicker than that of the front sidewall 9. Sidewall 5 may include a two ply construction as shown in FIG. 4. A gel 6 may be sandwiched between an exterior sidewall 5A and an interior sidewall 5B. The gel 6 may be heated or cooled for performing thermal treatments.

Figure 7:
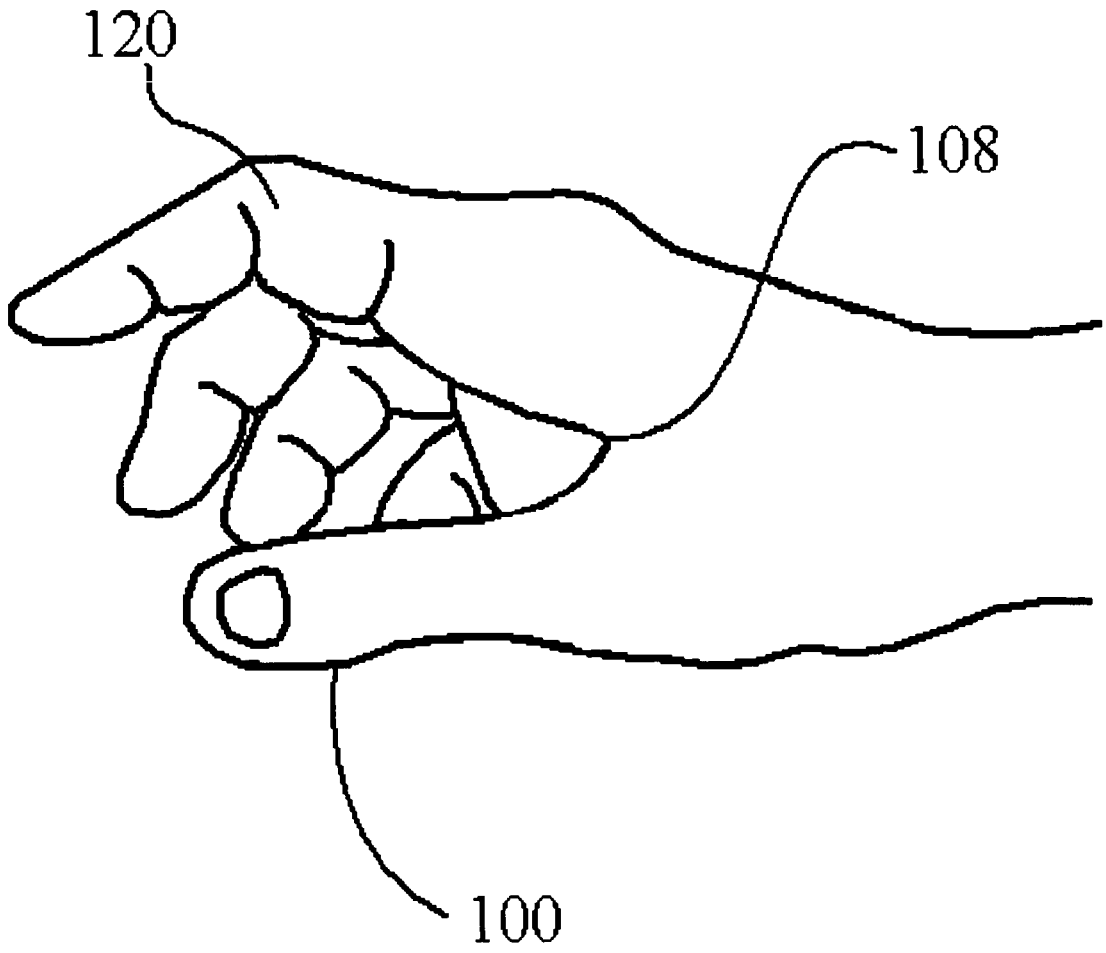
FIG. 7 is a cross sectional view of another embodiment of the present invention having a gel for thermal therapy.

The front sidewall 9 extends from the tip 3 to the muscle tissue 108, shown in FIG. 7. The front sidewall 9 is more rounded in shape than back sidewall 11. The front sidewall 9 may include a window of more pliable material located over thumb print area. That is, the thickness of the front sidewall 9 may be thinner than that of the back sidewall 11. The exterior and interior of tool 1 is formed in the shape of a thumb as shown. The exterior is smooth and has a skin-like feel to it such that one is receiving massage therapy cannot tell the difference when the tool 1 is used.

FIG. 1 shows the tool 1 having an interior of the device that includes an absorptive material 20 secured to the tool 1 via an adhesive 21. The absorptive material 20 may comprise cotton or other known materials that wick moisture away from the skin of the thumb of the user. Lip 7 may be rounded and is included around the base or open end of the 1. The lip 7 is elliptical in shape with the back side having a smaller radius of curvature than the front side as shown.

Figure 2:
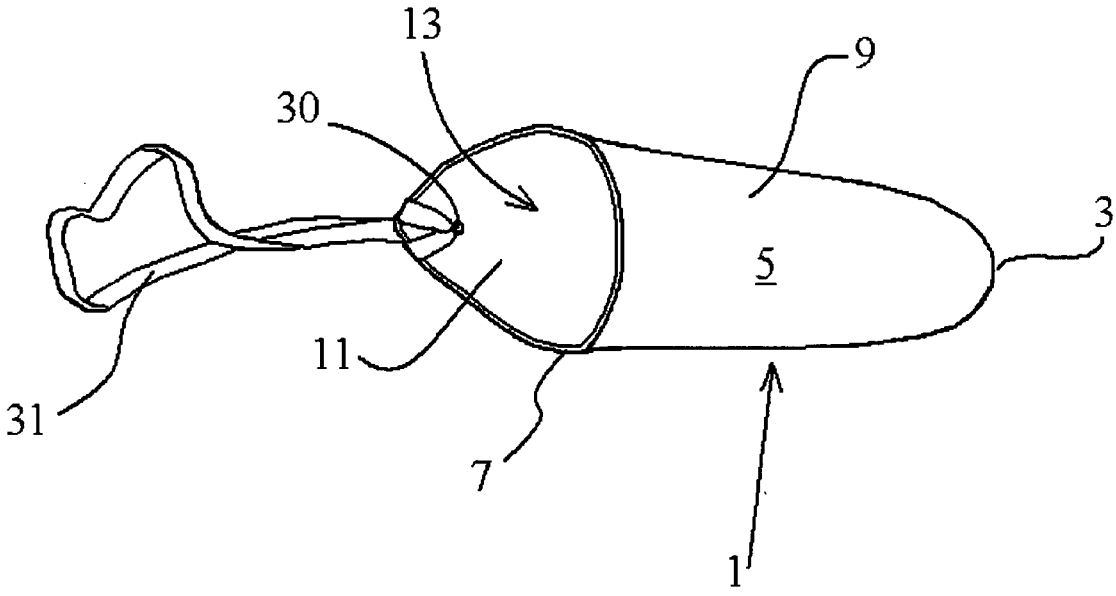
FIG. 2 is a perspective view of a second embodiment of the present invention and showing a supplemental device for securing the device to the thumb of the user.

FIG. 2 is a second embodiment of the tool 1 and showing a securing strap 31 that may secure the tool 1 to the wrist of a user. In this embodiment, the tool 1 is shown without an absorptive layer as in the first embodiment. The sidewall 11 includes a hole 30 through which the strap 31 passes. Typically a user passes his hand through the securing strap 31 and then inserts his thumb into the tool 1.

Figure 3:
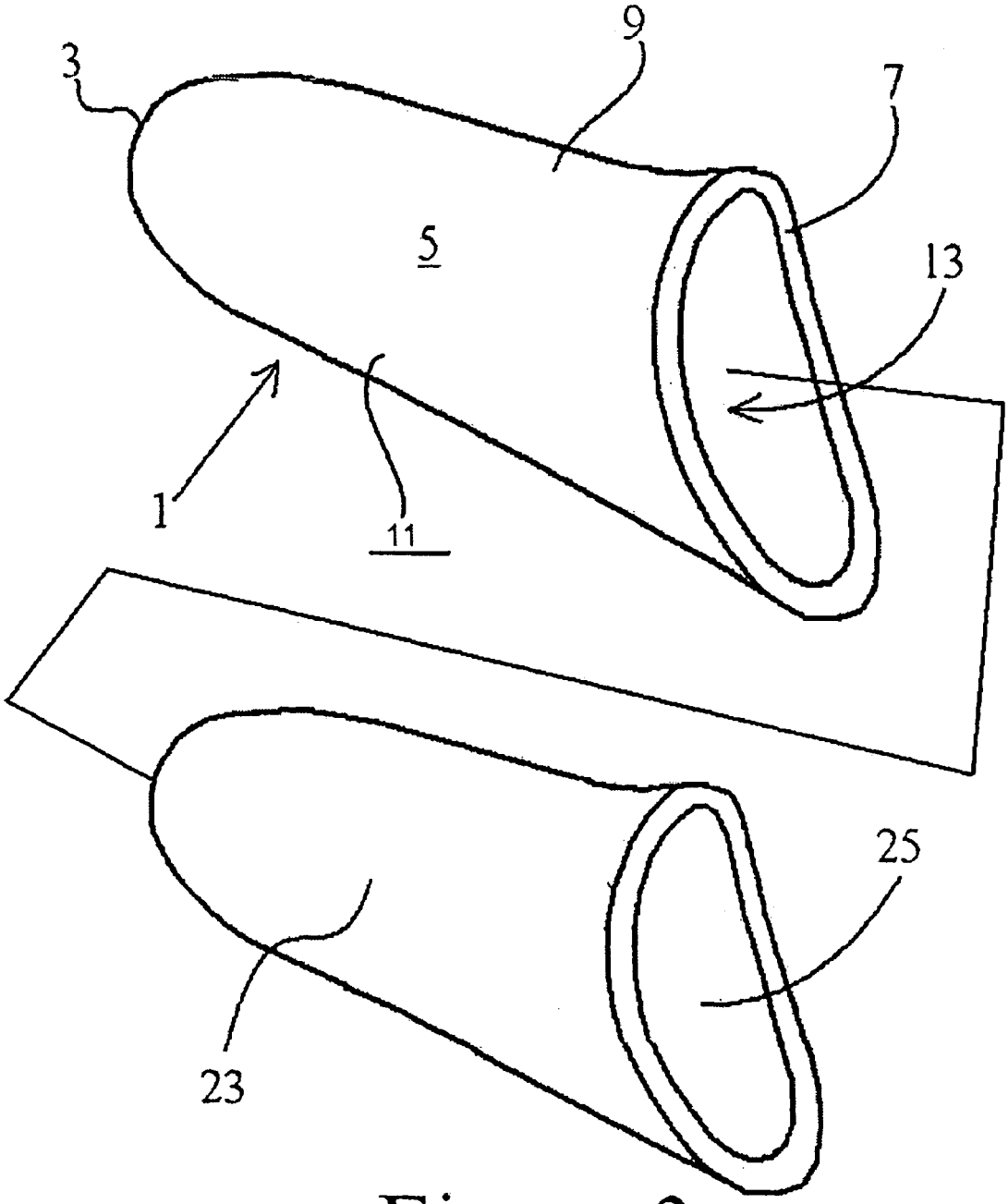
FIG. 3 is another embodiment of the invention showing a removable insert for the tool.

FIG. 3 is a third embodiment of the tool 1 and includes a removable insert 23. The insert 23 includes all of the features of the tool 1 except in may include a gel 6 as shown in FIG. 4. Thus, the user may either heat or cool the insert 23 to perform a thermal treatment as previously discussed.

Figure 5:
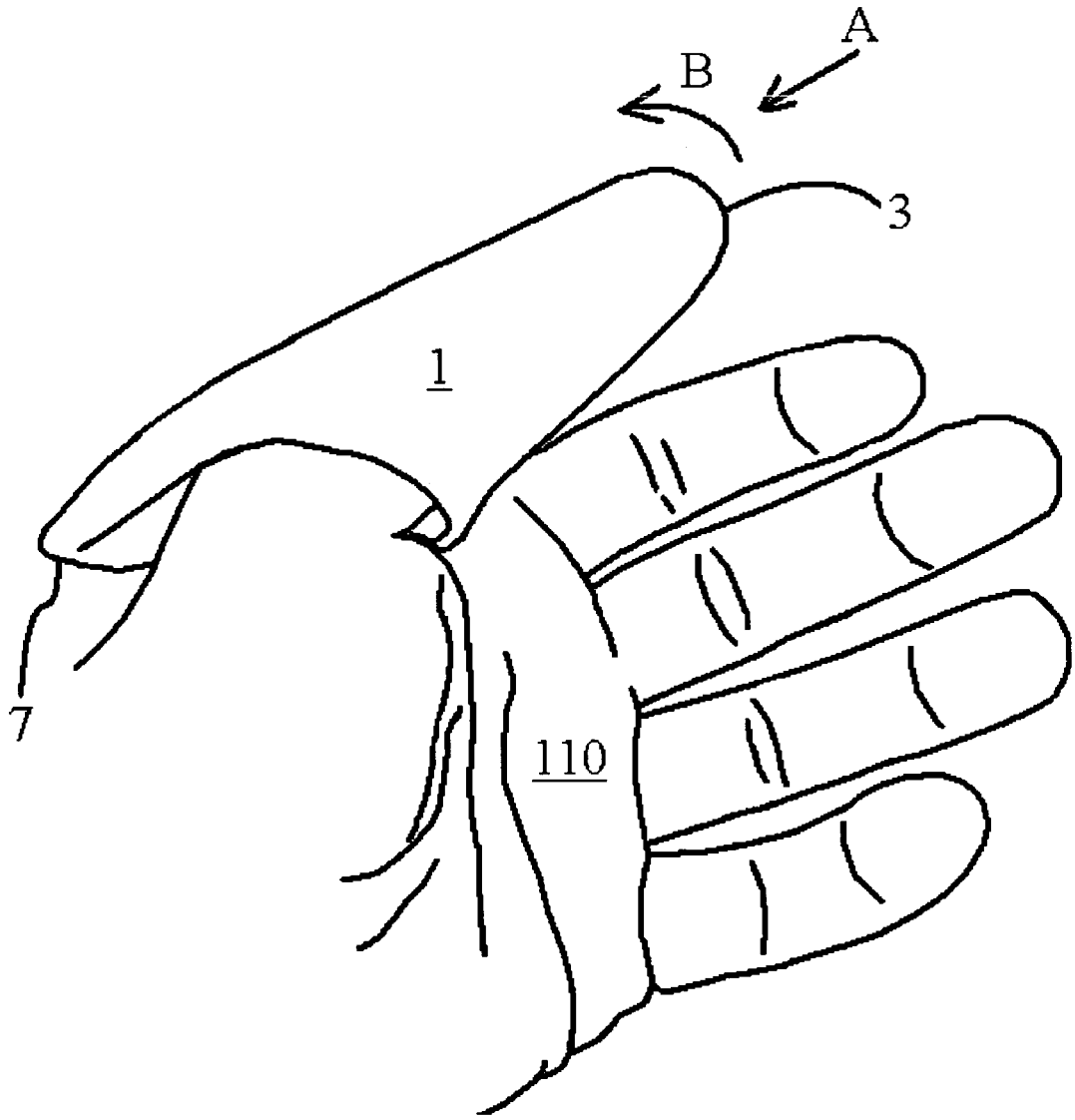
FIG. 5 is perspective view of the tool shown on a thumb of a wearer.
Figure 6:
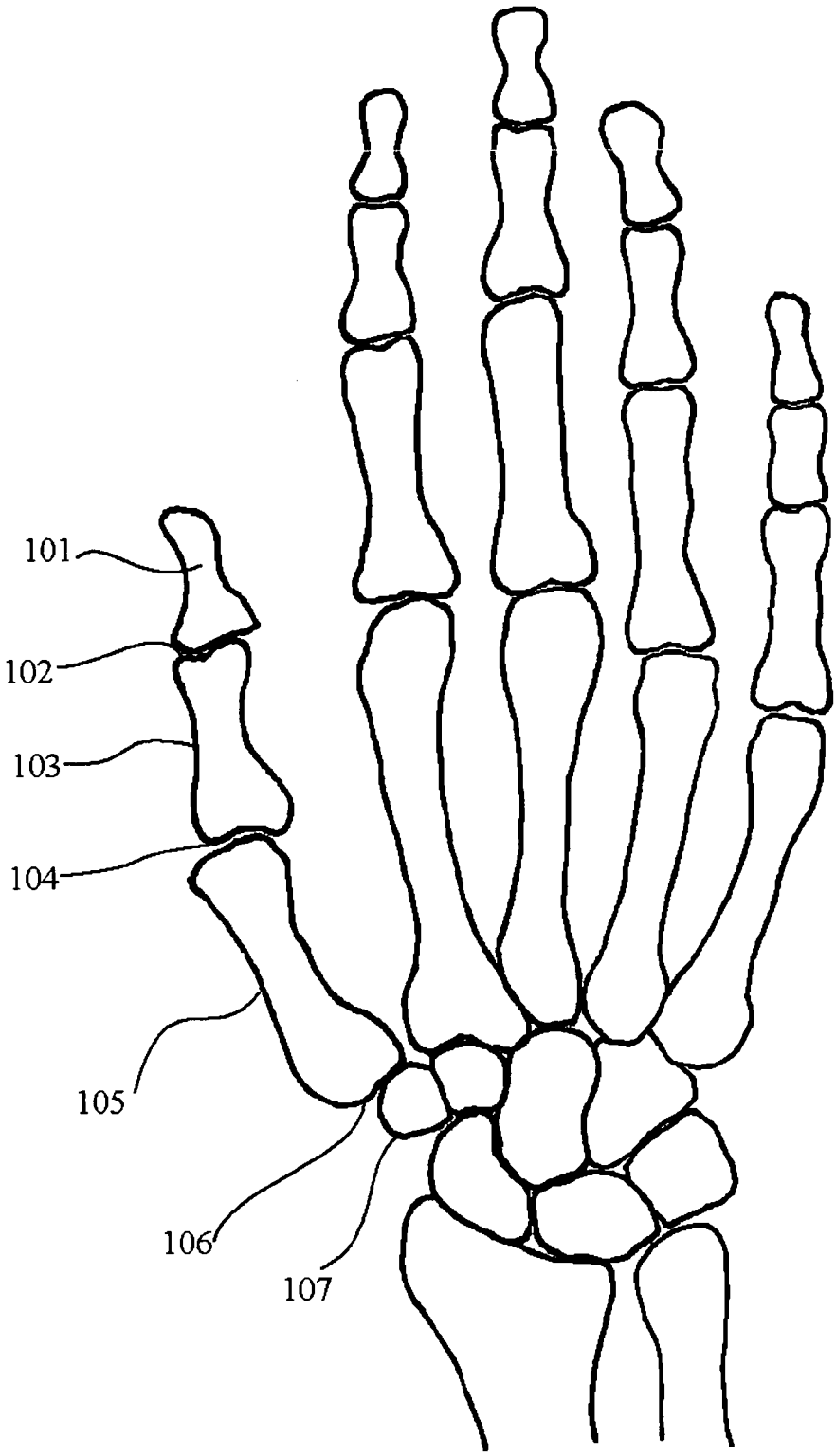
FIG. 6 is a posterior plan view of a hand and showing the various joints and bones in a thumb.

Now referring to FIGS. 5 through 7, which are views of the tool 1 and hand of a user. In FIG. 5, Arrow A indicates a compressive force that is exerted on the tip 3 of the tool 1 when a user is performing a massage therapy. During the therapy session, a flexor force, represented by Arrow B, is exerted on the tip 3 causing the thumb to be forced towards the wrist of the user. However, lip 7 contacts the area of the thumb or wrist near the trapezium 107 to resist the flexor force, thereby preventing the thumb from being overextended. The tool 1 allows the thumb to be folded into the palm 110 of the user's hand.

The tool 1 covers the distal segment 101, proximal segment 103, and thumb metacarpal 105 while providing compressive relief to the joints 102, 104, and 106. As can be readily understood, when used, the tool acts as an exoskeleton for the thumb 100 and transfers compressive forces from the tip of the thumb to the muscle tissue 108 between the thumb 100 and forefinger 120, as shown. Thus, the tool 1 may be used to prevent the bones, joints and surrounding tissue of the thumb from becoming injured and diseased as previously mentioned.

It is to be understood that the invention is not limited to the exact construction illustrated and described above, but that various changes and modifications may be made without departing from the spirit and the scope of the invention as defined in the following claims.

I claim:

1. A massage thumb tool comprising a PVC thermoplastic membrane, said tool adapted to receive a thumb of a user and comprising:

a closed tip for administering pressure to a muscle to be massaged;

a sidewall connected to said closed tip for transferring compressive forces from the closed tip to muscle tissue at a base of the thumb;

an opening arranged at an end of the sidewall opposite the closed tip for passing an end of the thumb therethrough;

said sidewall having a back portion and a front portion such that said back portion is longer than said front portion, wherein a thickness of material comprising the front portion is thinner than a thickness of material comprising said back portion;

said sleeve includes at least a portion thereof being pliable to allow the user to feel problem areas in the muscle tissue.

2. The massage thumb tool of claim 1 further comprising an insert that includes a gel for thermal treatment.

3. The massage thumb tool of claim 1 wherein said tool extends from a tip of a thumb of a user to a trapezium.

4. The massage tool of claim 1 wherein an exterior and interior surface of the tool is in a shape of a human thumb.

5. The massage tool of claim 1 further comprising a fastening device for passing a hand through.

6. The massage tool of claim 1 further comprising a two-ply sidewall that sandwiches a gel for use as a thermal treatment.

7. A massage thumb tool comprising a rigid tubular sleeve that slides over a thumb of a user to absorb compressive and flexor forces while allowing the thumb to be folded into a palm of the user, said tool comprising:

an open end for inserting the thumb into;

a lip surrounding said open end for transferring compressive forces from a tip of the thumb of the user to muscular tissue near a base of the thumb;

a sidewall connected to said open end and having a back portion and a front portion such that said back portion is longer than said front portion;

a closed tip connected to said sidewall opposite the open end;

said sleeve includes at least a portion thereof being pliable to allow the user to feel problem areas in the muscle tissue;

wherein a thickness of material comprising the front portion is thinner than a thickness of material comprising said back portion.

8. The massage thumb tool of claim 7 further comprising an insert that includes a gel for thermal treatments.

9. The massage thumb tool of claim 7 wherein said sidewall comprises an interior and exterior side wall sandwiching a gel.

10. The massage thumb tool of claim 7 further comprising a PVC thermoplastic membrane.

11. The massage thumb tool of claim 7 wherein said back portion extends from the tip of the thumb of the user to a trapezium bone.

12. The massage thumb tool of claim 7 wherein an exterior surface of said tool is smooth and formed in the shape of a thumb.

13. The massage thumb tool of claim 7 further comprising a fastening device for securing the device to the wrist of a user.

14. The massage thumb tool of claim 7 wherein said back portion and said closed tip comprise rigid material.

* * * * *